United States Patent [19]

Curry

[11] 4,283,660

[45] Aug. 11, 1981

[54] MULTILINE CHARGE TRANSFER PANEL INPUT AND HOLD SYSTEM

[75] Inventor: John L. Curry, Colorado Springs, Colo.

[73] Assignee: NCR Corporation, Dayton, Ohio

[21] Appl. No.: 69,158

[22] Filed: Aug. 23, 1979

[51] Int. Cl.[3] ..... H05B 41/30

[52] U.S. Cl. ..... 315/169.2; 340/768

[58] Field of Search ..... 315/169.2, 169.4; 340/768, 805

[56] References Cited

U.S. PATENT DOCUMENTS

| | | | |
|---|---|---|---|
| 3,781,600 | 12/1973 | Coleman et al. | 340/758 |
| 4,051,409 | 9/1977 | Craycraft | 315/169.2 |
| 4,190,789 | 2/1980 | Kawada et al. | 315/169.4 |

*Primary Examiner*—Eugene R. LaRoche

*Attorney, Agent, or Firm*—J. T. Cavender; Philip A. Dalton; T. Rao Coca

[57] ABSTRACT

A system for loading a DC multiline plasma charge transfer device and for holding charges applied thereto. Each line of the device includes input and transfer electrodes positioned on opposing walls which define a channel confining an ionizable medium. The transfer electrodes comprise adjacent groups of four electrodes with two driven in common with like electrodes of all other lines, and with timing of pulses applied by the common drivers being regular and constant. A common driver is also utilized for the input electrodes of each line while logic control is applied to the input driver and to the other transfer electrodes for each line. With this system and with a minimum of drive electronics, the charges may be shifted to a desired location and in desired patterns along the length of the device. The charges may be held at the desired location by circulating the charges between a set of electrodes at the desired holding location including two commonly driven electrodes. Additional input can be achieved on any line while maintaining prior input.

11 Claims, 9 Drawing Figures

FIG. 1
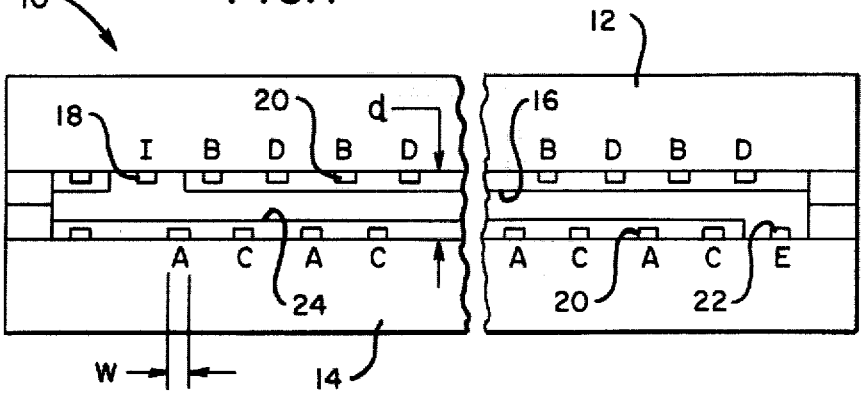
FIG. 4
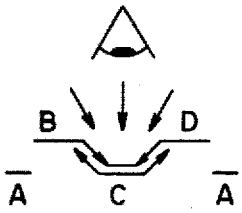
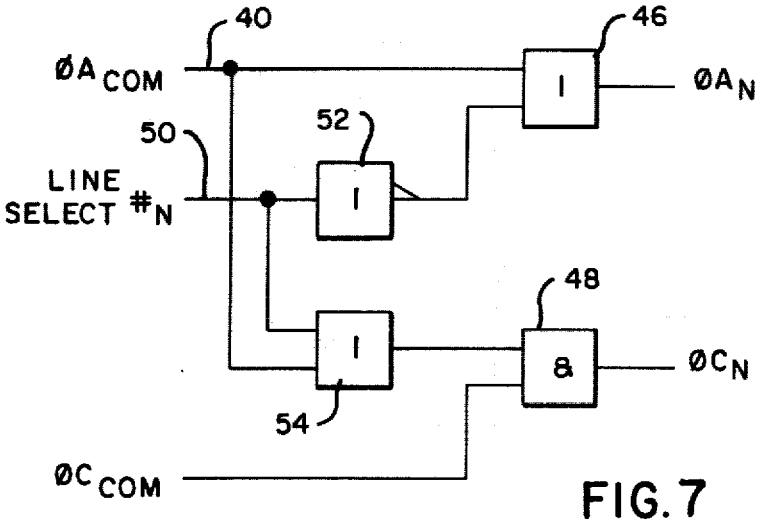
FIG. 7

LOAD

HOLD

WIPE

MULTILINE CHARGE TRANSFER PANEL INPUT AND HOLD SYSTEM

BACKGROUND OF THE INVENTION

This invention relates to a multiline plasma charge transfer panel and to a method and means for operating the device.

Devices of the general type referred to are described in Coleman et al., U.S. Pat. No. 3,781,600, dated Dec. 25, 1973, entitled "Plasma Charge Transfer Device". Such devices generally comprise a channel containing an ionizable medium, particularly an ionizable gas such as neon and nitrogen. The channel is defined within a walled structure, and for display purposes, at least one wall is formed of a transparent material. An input electrode is provided at one end of the device, and transfer electrodes are located in opposite, alternate positions along a line extending along the channel. By applying potential differences between the oppositely positioned electrodes, the gas is ionized, and light emission occurs. By applying the potential differences in proper sequence, and particularly through the utilization of a plurality of channels, light displays of numbers, letters, or other patterns can be realized. The arrangement permits shifting of the displays along the length of the devices, and holding of the displays in position when so desired.

Craycraft U.S. Pat. No. 4,051,409, dated Sept. 27, 1977, and entitled "Load and Hold System for Plasma Charge Transfer Devices" describes a system wherein information previously loaded into a device can be retained while new information is loaded into the device: the previously loaded information is shifted along the device in synchronism with the information being newly loaded. The system involves the circulation of charges at a holding location in a fashion such that a display or other function can be achieved and subsequently shifted. The technique particularly involves circulating of charges between at least four sequentially positioned transfer electrodes whereby the charges can be efficiently held for a desired period of time and thereafter shifted. New charges are then loaded without the need for reloading of any previously introduced charges.

SUMMARY OF THE INVENTION

The improved system of this invention generally comprises a DC input multiline plasma charge transfer device. Each line of the device comprises one or more channels. Each channel includes an input electrode and transfer electrodes positioned alternately on opposing channel walls which confine an ionizable medium. The transfer electrodes are divided into adjacent groups (cells) of four electrodes. Two transfer electrodes on one wall are driven in common with like transfer electrodes of all other lines in the device; the other two transfer electrodes are driven independently. The timing of pulses applied by the common drivers comprises a regular and constant timing.

Common drivers are utilized for the input electrodes and two common drivers are utilized for the common transfer electrodes of all lines in the device. A logic control is applied to the input drivers, and also to the two independent transfer electrodes of each line. The two independent transfer electrodes of any given line and the common input electrodes can be selectively controlled to operate in phase with the regular and constant driving of the two common transfer electrodes.

The system involves a minimum of drive electronics while providing maximum flexibility in terms of operating efficiency. Thus, charges may be loaded selectively on any line, and the charges may be shifted to any desired location along the length of the respective lines. A charge may be held at a desired location by circulating the charge between a set of electrodes at the desired holding location, this set including the two commonly driven electrodes at that location. Additional input can be selectively achieved on any line while maintaining prior input.

The system enables the achievement of these results without any significant degradation of the sustain voltage and input voltage window, which determines the operating margin. In addition, adverse characteristics, such as dimming, flicker, and flash caused by charge movement are minimized. Moreover, the display is characterized by highly satisfactory visibility during a hold sequence. In addition, the phase timing logic can be modified to provide a wipe sequence prior to a load sequence to effect the desired margin.

BRIEF DESCRIPTION OF THE DRAWINGS

FIG. 1 is a cross-sectional view of a plasma charge transfer channel of the type employed;

FIG. 4 is a schematic view illustrating the discharge pattern during a hold sequence;

FIG. 7 is a diagrammatic view of suitable electronics for selectively driving transfer electrodes; and, FIG. 8 is a waveform diagram illustrating the characteristic pattern of a wipe sequence.

DESCRIPTION OF THE PREFERRED EMBODIMENT

Figure 2:
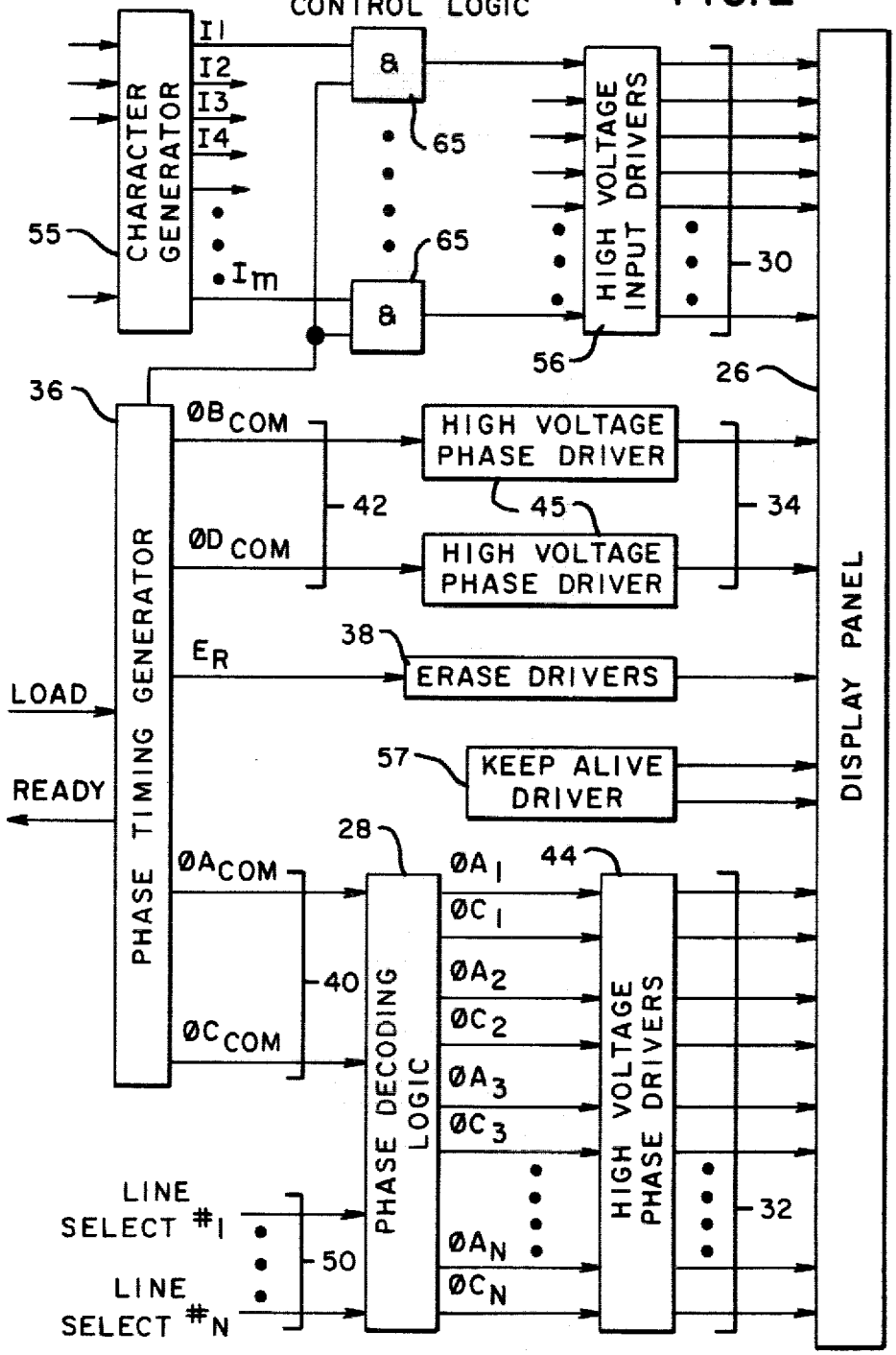
FIG. 2 comprises an illustration of a control circuit suitable for the system of the invention.

A plasma display channel 10 of the type involved in the practice of the invention is illustrated in FIG. 1. This structure comprises a rear plate 12 and a front plate 14. In the usual practice of the invention, at least the front plate is formed of a transparent material, for example any suitable glass, whereby ionization with result in a visible display. It will be understood that such ionization occurs even in systems which involve data input without a visible display and, accordingly, the concepts of this invention can be practiced even though a visible system is not involved.

The plates 12 and 14 are held in spaced-apart relationship whereby a channel 16 is defined between the plates. The ionizable medium may comprise any one of, or a mixture of, at least the gases neon, argon, helium, krypton, xenon, hydrogen and nitrogen, and the medium is sealed within the channel 10. A plurality of electrodes including input electrode 18, transfer electrodes 20, and erase electrode 22 are disposed on the opposing walls of the channel 10. Electrodes 20 on the transparent plate 14 may be formed of transparent material such as tin oxide although this is not necessary. A thin insulating coating 24 covers the transfer electrodes 20, and at least the coating on the plate 14 may be transparent, for example, a dielectric glass formed of a silk screened glass paste. Since the front and rear electrodes are staggered, visible display "dots" will occur even if the front electrodes are opaque.

The structure of FIG. 1 involves the presence of the ionizable medium between the opposed alternating transfer electrodes. Thus, the electrodes comprise interdigitated members, and they are positioned in a regular alternating sequence, indicated by the letters "A", "B", "C" and "D". Reading from left to right from the input electrode 18, the electrodes form an ABCD, ABCD, etc. sequence. Each group of four ABCD electrodes comprises a display cell.

For the reasons more particularly set forth in the aforementioned U.S. Pat. No. 3,781,600, the input electrode 18 may be exposed to the ionizable medium, that is, it is not covered by the insulating material 24. This enables start-up of the device when a sufficient potential difference is developed between the input electrode and the oppositely positioned transfer electrode 20 (designated A). The potential difference results in the creation of a positive charge adjacent the transfer electrode as is characteristic of devices of this type. By creating a sufficient potential difference between the next adjacent electrode B and the electrode A with the positive charge, the ionization position will shift. The charge can then be moved progressively along the channel by continuing to apply potential differences between adjacent electrodes.

The above description applies to a single channel, and the ionization would result in one or more "pips" of light along the length of the channel as the changes in potential (pulses) are applied. It should be noted that the channels 10, FIG. 1, can be grouped to form a line for displaying numbers, letters, or other patterns. For example, one frequently used line-forming arrangement of channels involves an $n \times m$ matrix of n horizontal display cells in each of m horizontally extending channels. For example, an exemplary line consisting of a $5 \times 7$ matrix involves $n=5$ display cells (five cells ABCD, FIG. 1) in each of $m=7$ horizontally extending channels arranged in a vertical plane. Each line 1-N of a panel 26, FIG. 2, will have its individual inputs 1-m connected to the corresponding inputs 1-m of the other lines.

Hereafter, where necessary to avoid confusion with the above-described lines formed by display channels, the electrical connecting lines such as 30, 32, 34, 40 and 50 of FIG. 2 will be termed "connector lines".

For any channel, all of the electrodes 20 with the same letter designation are connected in common so that an A pulse changes the potential of each A transfer electrode, a B pulse changes the potential of each B transfer electrode, etc. Accordingly, and as more fully explained in the aforementioned Coleman et al. and Craycraft patents, which are incorporated by reference after one charge is introduced, additional charges are introduced by providing an input pulse in conjunction with an A pulse. This enables shifting of several charges simultaneously along the same channel.

FIG. 2 schematically illustrates display panel 26 and associated controls. These include the control logic 55 connected to input drivers 56 for applying input pulses through connector lines 30. As noted, the input electrodes for all lines are driven in common, so that the applied input pulses for an input electrode of the first line are directed to the corresponding input electrode of all lines.

Drivers 44 and lines 32 are provided for pulsing the independent A and C transfer electrodes. In this instance, a separate driver is provided for the A transfer electrodes of each line, and a separate driver is provided for the C transfer electrodes of each line. The phase decoding logic 28 can selectively drive the A and C transfer electrodes of a given line independently of the transfer electrodes on any other of the N lines.

Drivers 45 are provided for the B and D transfer electrodes, which are connected in common for all lines. As noted, these drivers operate on a regular and constant basis at a desired frequency. Every B and D transfer electrode on the panel is pulsed in phase and therefore, logic control for selectively operating these electrodes is not required.

"Erase" drivers 38 may be utilized in any conventional form, and conventional "keep-alive" drivers 57 may be provided.

Figure 5:
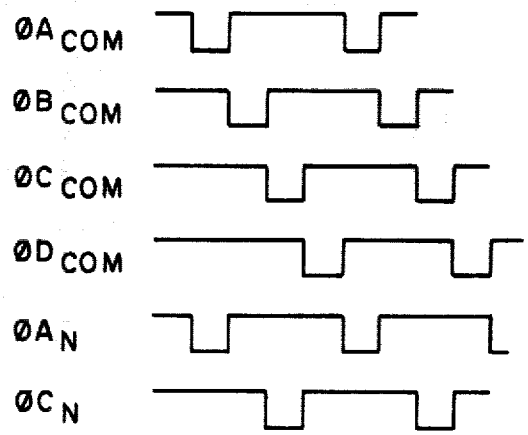
FIG. 5 is a waveform diagram illustrating the characteristic pattern of a load sequence.
Figure 6:
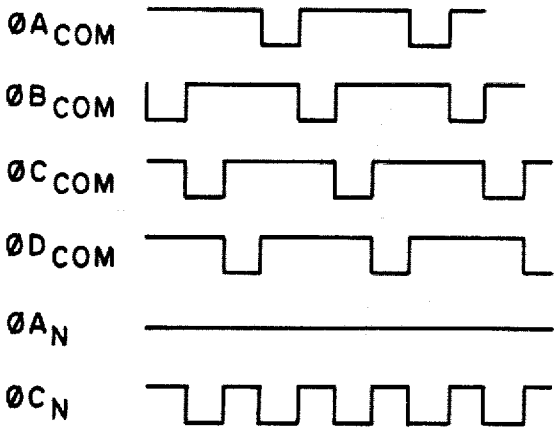
FIG. 6 is a waveform diagram illustrating the characteristic pattern of a hold sequence.

FIGS. 5 and 6 illustrate the patterns developed during operation of the display panel. As with other patterns discussed herein, these illustrate voltage conditions as they change over a period of time.

The pattern of FIG. 5 comprises a pattern characteristic of a loading or charge-shifting operation, and, in this example, it is assumed that the transfer electrodes are normally maintained at positive voltage, for example, 145 volts. When the driver for a line operates, the voltage is caused to drop to zero or ground.

As shown in FIG. 2, a phase timing generator 36 provides the common signals for the A, B, C and D transfer electrodes. The signals for the A and C electrodes are transmitted via connector lines 40 to the phase decoding logic 28. The signals for phases B and D are transmitted, via lines 42 to high voltage drivers 45. As noted, these include drivers for transmitting signals through lines 34 whereby all B and D electrodes are pulsed in a constant and regular fashion. The voltage patterns of FIGS. 5 and 6 illustrate this regular pulsing.

The phase decoding logic 28 selectively controls individual drivers 44 for the A and C electrodes of each line on the display panel. In this fashion, a loading sequence for any individual line can be achieved. FIG. 5 illustrates the "load" sequence for line N.

Loading involves the pulsing of the A electrodes followed by pulsing of the B, C and D electrodes in sequence. Because of the location of the electrodes as shown in FIG. 1, a charge will move from left to right under these circumstances. The loading of a charge occurs when the input electrodes is at high voltage during pulsing of the A transfer electrode. Shift occurs in the case of charges which are already in the system since the potential difference between the adjacent electrodes will result in movement of the charge from left to right.

FIG. 6 illustrates the "hold" pattern which is characteristic of this invention. This involves maintaining an already existing charge in a general location in a channel 10. To achieve this, the A electrodes are maintained at high voltage and are thus not receptive to a charge from either the input electrode or from an adjacent B electrode. On the other hand, the B and D electrodes maintain the characteristic pattern since, as already noted, these electrodes are driven in a regular and constant fashion. Specifically, they are driven to low voltage once during each four-pulse "hold" time cycle with the voltage changes of the respective electrodes occurring in alternating fashion.

The C electrodes are driven to low voltage twice during each hold time cycle, and the operating phase is such that the C pulses always occur between a B and D pulse. Again referring to FIG. 1, it will be appreciated that this results in a holding condition since a charge at any location along the length of the device will be caused to circulate between adjacent B, C and D electrodes of a cell. The charge cannot move beyond these three electrodes since the A electrode is maintained at high voltage and is, therefore, not receptive to a charge.

It will be appreciated that the loading, shifting, and holding functions described are all achieved even though two of the four electrode sets are driven in the constant and regular patterns illustrated. Thus, it is only necessary to control the input and A and C electrodes in order to achieve the desired functions.

The hold sequence characteristic of the invention provides additional advantages as illustrated in FIG. 4. In this instance, the plasma discharge between the adjacent B and C, and C and D electrodes is shown. The arrows illustrate the fact that the discharge will be visible even though the viewer may be standing at an angle to the display panel. This is in contrast to a CD hold characteristic of many devices since in that instance the discharge tends to be obscured at certain viewing angles.

The hold sequence also avoids the problems referred to in the aforementioned Craycraft patent. As noted therein, a CD hold system is not suitable for purposes of shifting a previously introduced charge while introducing a new charge. Under those circumstances, it is necessary to reintroduce old information along with new information and, as will be more thoroughly explained, that is not required with the system of this invention.

Figure 3A:
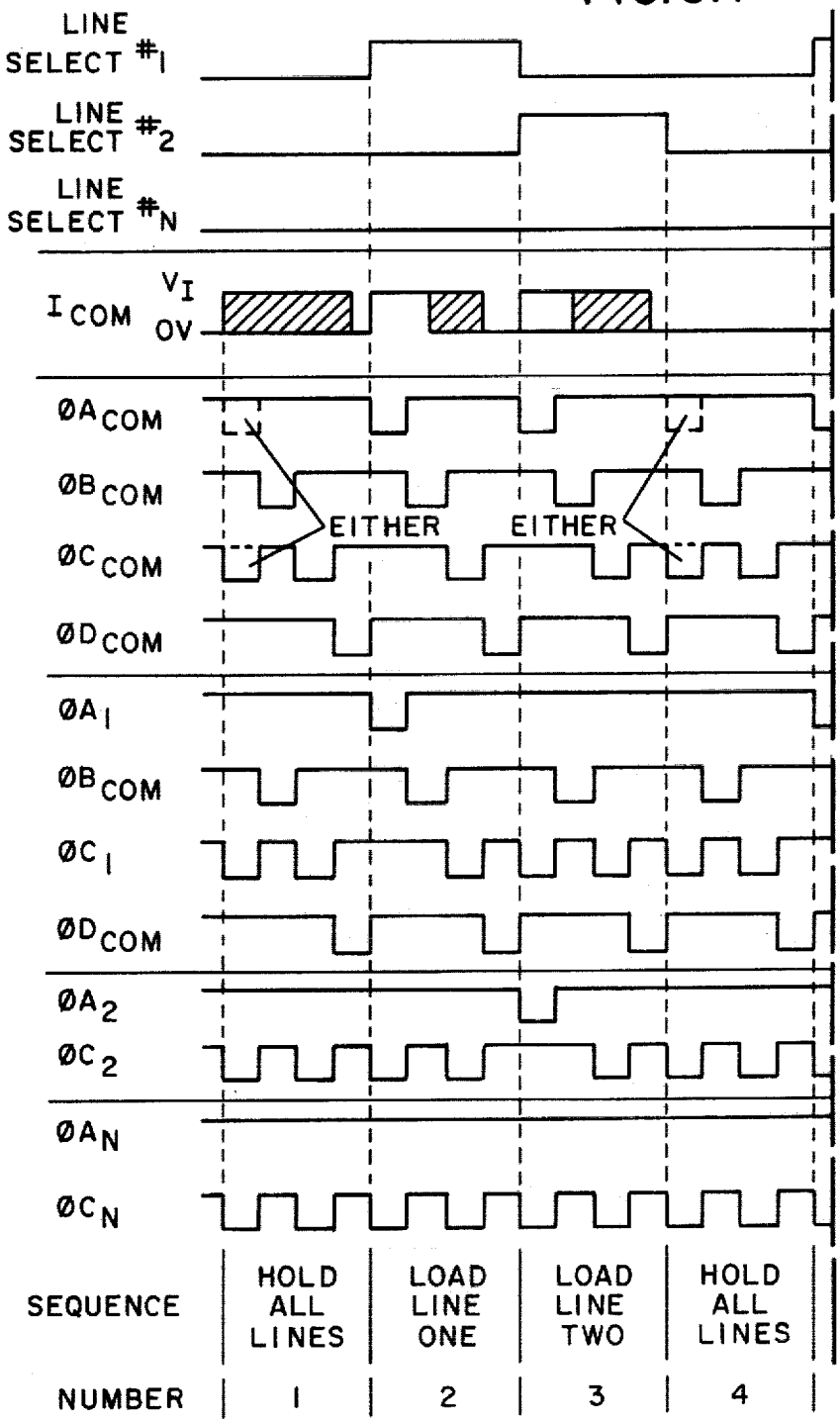
FIGS. 3A and 3B are an illustration of a waveform sequence characteristic of the operation of the invention.
Figure 3B:
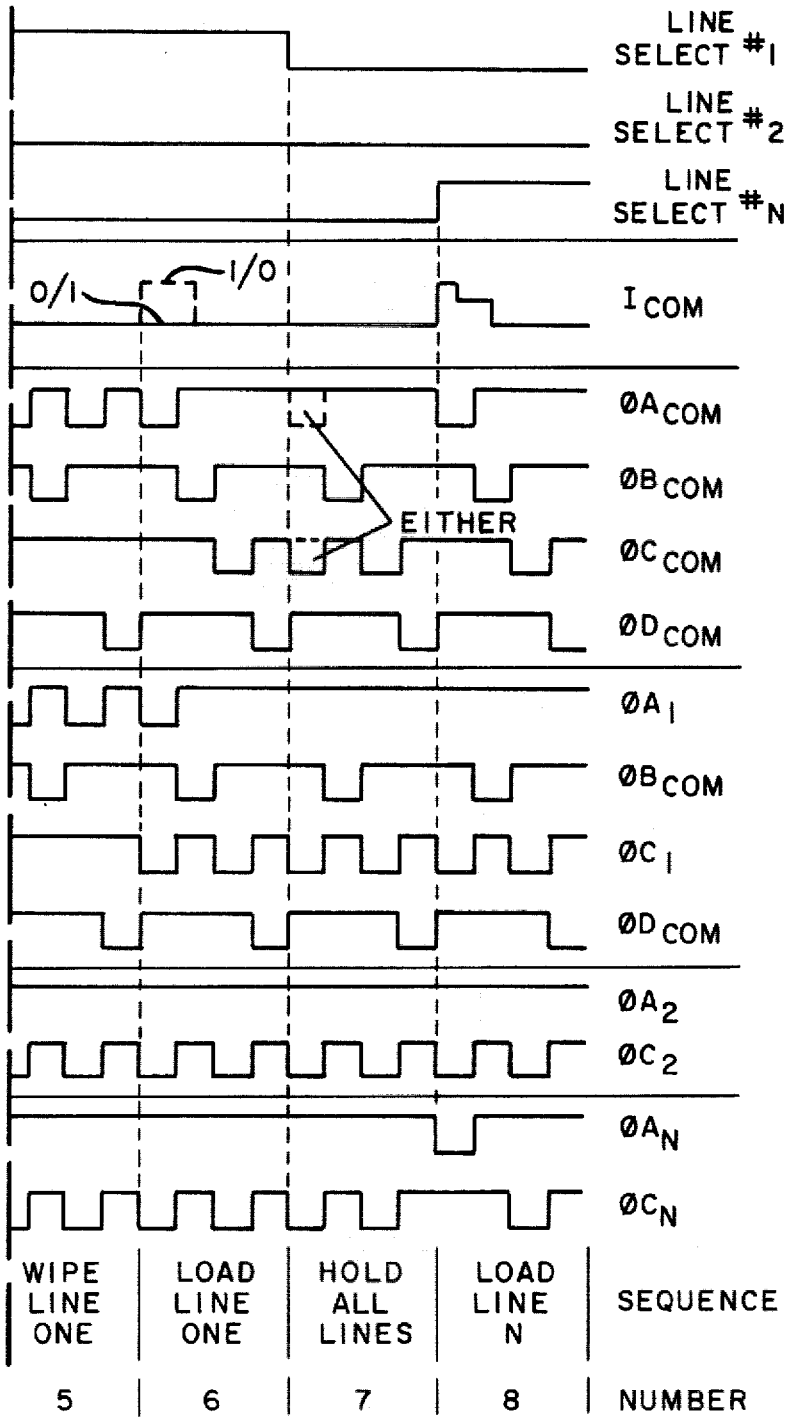

FIG. 3 illustrates the controlling waveforms for a typical operating sequence. The figure is intended to represent a multiline panel with "N" number of lines.

In FIG. 3, the phase B and phase D patterns $\phi B_{COM}$ and $\phi D_{COM}$ are the pulses common to all B and D electrodes of all lines.

Also in FIG. 3, the input electrode is normally maintained at zero voltage and is driven to a high voltage, $V_I$, for example $V_I=220$ volts, when a charge is to be introduced on any given line. In the illustration, a hold sequence (sequence 1) occurs prior to the first loading sequence (sequence 2). This hold sequence follows the pattern of FIG. 6.

Next, in the "load line 1" sequence, a first charge is introduced to a channel of line 1: the logic has driven all m (or selected ones of the m) input electrodes the $V_I$ and the A electrodes of line 1 to zero voltage. This develops a sufficient potential difference so that a charge is applied to the first A transfer electrode of selected channels of line 1.

Those skilled in the art will appreciate that, as described in the previous paragraph, it is possible to select any or all of the m channel input electrodes for a line so that a high voltage, $V_I$, is applied to develop the gas discharge and resulting wall charge at the first A transfer electrode of each selected channel. However, for simplicity in the following discussion, it is assumed that each line includes a single channel.

Next, the B transfer electrode is driven to zero voltage as the A transfer electrode returns to high voltage. This results in transfer of the wall charge to the first B electrode of the channel of line 1. Since the load sequence is being followed, the first C electrode is driven to zero voltage as the B electrode returns high. For this reason, the charge shifts to the first C electrode and subsequently to the first D electrode as the voltage of these electrodes changes. It will be noted that the pattern of this portion of FIG. 3 (load line 1; sequence 2) corresponds with the load pattern described and shown in FIG. 5.

As will be explained in greater detail, the phases of the pulses for the B and D electrodes are controlled so that pulses from the A and C electrodes can be selectively interposed between the B and D pulses. Thus, the invention provides for all functions of the display panel even though the B and D electrodes are operated on the regular and constant basis described.

In this connection, the description of the electrodes is totally arbitrary, and no limitation should be assumed because of the use of the particular letters for designating the electrodes. In the scheme described, the C phase electrodes are fired in phase between the B and D common phases. It will be apparent that the A electrodes could also be considered as the center between the B and D common electrodes. Similarly, the B electrodes could be the center with A and C common, or the D electrode could be the center with A and C common. With these alternatives, appropriate changes would be made in the input-enter sequence.

Referring back to the illustration of FIG. 3, in the "load line 2" (sequence 3), the channel of the second line (N=2) of the panel is loaded with a charge while the other lines are in a hold sequence. Specifically, the voltage of the first electrodes $A_2$ drops to zero while the input voltage is high. This results in the introduction of a charge on the second line, and the charge is then shifted, respectively, to the first B, C and D electrodes of that second line. On the display panel, this charge on the second line, even though introduced at a latter time, will appear directly beneath the charge on the first line.

A hold sequence (sequence 4) is illustrated as occurring subsequent to the loading of a charge on line 2. This hold sequence follows the pattern shown in FIG. 6 wherein the charge is circulated between the D, C and B electrodes of the first cell lines 1 and 2 on the display panel. This hold sequence is for all lines of the display. The initial pulse may be either $\phi A_{COM}$ or $\phi C_{COM}$, to cause $\phi A_N$ or $\phi C_N$ to pulse on all lines. Initial $\phi A_N$ transfers the charge to the succeeding cell, where the following standard BCD hold pulsing retains the charge. Initial $\phi C_N$ retains the charge in its same cell (here the cell associated with the "load line 2" sequence).

Figure 8:
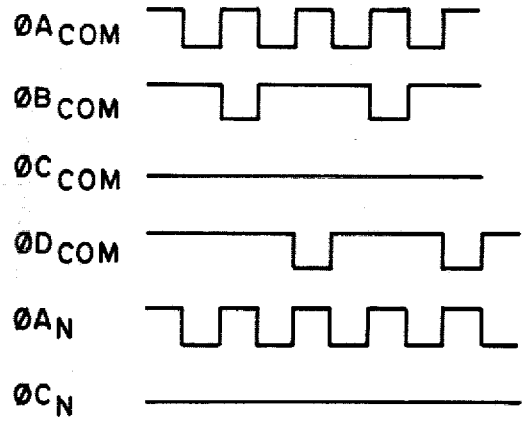

The next function illustrated in FIG. 3 is a "wipe line 1" function (sequence 5). This involves circulation of a charge between A and B electrodes for purposes of avoiding collection of charge residue on more than one electrode prior to shifting of a charge. Thus, it has been observed that adjacent electrodes will tend to share a charge whereby reducing its effective strength, and the wiping operation serves to collect at least the majority of the charge on a single electrode. This operation is most significant after a charge has been held in one location for any length of time. Although the "wiping" is not itself a part of this invention, reference is made to that function for purposes of illustrating that the system of the invention permits this function. To provide for a wipe sequence, the phase timing generator 36 (FIG. 2) must change from the standard regular sequence shown in FIGS. 5 and 6 to the sequence described in FIG. 8, prior to a load sequence.

The next sequence shown in FIG. 3 involves the loading of an additional charge on the channel of line 1 (sequence 1). It will be noted that to achieve this, $\phi A_1$ drops to zero simultaneously with the application of the input voltage $V_I$. The new charges on line are then shifted, one behind the other, along the line due to the introduction of B, C and D pulses. It will be appreciated that this pulsing also automatically advances the first charge introduced on the channel of line 1. Accordingly, the system permits the introduction of new charges on a line while automatically retaining the charges already introduced.

During the loading of a charge on a line, the charge previously introduced on other lines is held. Thus, in "load line 1" (sequence 6) the voltage of the A electrodes of line 2 is maintained high while the logic applies the hold pulsing sequence to the C electrodes of line 2. This pulsing, in combination with the regular pulsing of the B and D electrodes of line 2, holds the charge on line 2 in its original locations.

The previous load sequences ("load line 1" and "load line 2", sequences 2 and 3) have referred to the loading of charge, which can represent either binary 1 or 0 (with the absence of charge then representing 0 or 1). The "load line 1" function of sequence 6 indicates that the opposite also holds, i.e., that loading could be accomplished by application of an input voltage of zero volts to preclude the input of charge.

The seventh sequence is a "hold all lines", which is identical to the "hold all lines", of sequences 1 and 4, and maintains each charge within the same set of electrodes the charge occupied during the preceding (sixth) sequence.

The final sequence shown in FIG. 3 involves the loading of a charge on line "N" (sequence 8). While this charge is being loaded, the C electrodes for lines 1 and 2 are in the hold mode. It will thus be appreciated that any line of the panel can be loaded while other lines of the panel retain the previously introduced information and the position of that information. This final sequence of FIG. 3 also illustrates an alternative procedure for controlling the input electrodes. Specifically, it will be noted that the voltage of the input electrode is driven to a high level, for example $V_I=220$ volts, for a short period, typically about 10 microseconds. The input voltage is then reduced for a period of about 20 microseconds to an intermediate voltage and then reduced to ground. Compared with the voltage of the A electrodes, it is preferred that the input electrode be held at high voltage for a period greater than one-half the time the A electrodes are held at ground but less than the entire time the A electrodes are held at ground. The total of the high voltage and intermediate voltage duration of the input electrode is preferably greater than the time the A electrodes are held at ground but less than the combined time that the A and B electrodes are held at ground. Typically, the A electrodes are held at ground for 20 microseconds with the combined time for the A and B electrodes being 40 microseconds.

The alternative input operation shown in FIG. 3, sequence 8, has been found to avoid the problem of a co-planar discharge on an unselected line. Specifically, by reducing the input voltage from high to intermediate before the B electrodes on an unselected line change to ground, and by holding the input electrode at this intermediate voltage during this time (while unselected B is going to ground), a discharge laterally from the input electrode to the adjacent B electrode is effectively avoided.

FIG. 7 illustrates a portion of a logic system 28 which may be utilized for controlling the drivers of A and C electrodes of a given line. As indicated, the A and C common signals enter through lines 40 with the A common signals being directed to OR gates 46 and 54, and with the C common signals being directed to AND gate 48. Line select signals are directed to the logic through lines 50 as shown in FIGS. 2 and 7. Line select 50 is applied as input to NOT gate (inverter) 52 and to OR gate 54. The outputs of inverter 52 and OR gate 54 are applied to the second input terminals of OR gate 46 and AND gate 48. When information is to be loaded onto or shifted along a given line, a line select signal is introduced for that line.

The following "truth" table illustrates the manner in which the logic controls the voltage of A and C transfer electrodes of a given line:

| Input | | | Output | |
|---|---|---|---|---|
| $\phi A_{COM}$ | $\phi C_{COM}$ | Line Select | $\phi A_N$ | $\phi C_N$ |
| 0 | 1 | 0 | 1 | 0 |
| 1 | 1 | 0 | 1 | 1 |
| 1 | 0 | 0 | 1 | 0 |
| 1 | 1 | 0 | 1 | 1 |
| 0 | 1 | 1 | 0 | 1 |
| 1 | 1 | 1 | 1 | 1 |
| 1 | 0 | 1 | 1 | 0 |
| 1 | 1 | 1 | 1 | 1 |

The following equations illustrate the manner in which the system of FIG. 7 and the truth table are related:

$$\phi A_N=\phi A_{COM}+\overline{\text{Line } \#_N \text{ Select}}$$

$$\phi C_N=(\phi A_{COM}+\text{Line } \#_N \text{ Select})\cdot\phi C_{COM}$$

As indicated by the table, the logic provides for a holding sequence on a given line as long as the voltage of the A electrodes is high. This voltage is maintained high since, as indicated by the first equation, the voltage of the A electrodes is controlled in accordance with the sum of the A common voltage and the inverted line select signal from 52. This is true even when the voltage of A common drops once during each cycle of operation.

When a line is selected, a load or shift condition is provided by the logic. Both the A and C electrodes of the selected line are pulsed to low voltage once during each cycle and in alternating fashion. It will be appreciated that the pulsing of the B and D common electrodes is controlled so that these electrodes experience regular voltage drops which are interposed in the cycle so as to achieve the desired charge transfer.

It will be noted that the circuitry of FIG. 7 is such that the C electrodes will pulse low twice during each cycle if the line is not selected even though C common goes low only once during each cycle. This occurs because the gate 48 drives the C electrodes low for a given line whenever C common is high and both A common and line select are low. Thus, the gate 48 will maintain high only when the sum of A common plus line select is high at the same time that C common is high. This provides one illustration of the fact that relatively uncomplicated electronic means are required for achieving the functions necessary for operating the display panel.

It will be understood that various changes and modifications may be made in the above described system while providing the features of the invention particularly as set forth in the following claims.

What is claimed is:

1. In a multiline plasma charge transfer device wherein the lines each comprise at least one channel containing an ionizable medium, input and transfer electrodes positioned on inside wall surfaces, the transfer electrodes being alternately arranged on opposite wall surfaces, and control means including drivers for firing the electrodes to develop potential differences between the electrodes, application of potential differences serving to introduce charges into the channels, and serving to hold and shift changes in the channels, the improvement wherein said control means include first drivers for all transfer electrodes on one wall surface of all lines, means for operating said frist drivers in regular phase, independent second drivers for the transfer electrodes on the other wall surface of each line, means for selectively operating each of said second drivers, third drivers connected to the input electrodes of all lines, and means for selectively operating said third drivers.

2. A device in accordance with claim 1 including one common firing means for each set of alternating transfer electrodes, said first drivers being connected to separate common firing means for operating of the first drivers by the separate common firing means, and logic means interposed between said second drivers and the other common firing means, said logic means including line select means for controlling the firing of transfer electrodes on said other wall surface by said other common firing means.

3. A device in accordance with claim 2 wherein one of said second drivers operates to fire a transfer electrode on said other wall in conjunction with the firing of said input electrode to load a charge on a line, the regular firing by said first drivers of transfer electrodes on said one wall shifting said charge, and means for operating the other of said second drivers to further shift said charge, the regular firing by said first drivers of the next transfer electrode on said one wall further shifting said charge.

4. A device in accordance with claim 2 including means for firing one second driver in phase between the regular firing by said first drivers whereby a charge on a line is adapted to circulate between a transfer electrode on said other wall and two transfer electrodes on said one wall.

5. A device in accordance with claim 2 including separate logic means for each line of said device, said line select means providing signals selectively applicable to said logic means whereby the logic means are adapted to individually control the charges introduced to any line of the device.

6. In a method for operating a multiline plasma charge transfer device, the device being of the type wherein the lines each comprise at least a channel containing an ionizable medium, input and transfer electrodes positioned on inside wall surfaces, the transfer electrodes being alternately arranged on opposite wall surfaces, and control means including drivers for firing the electrodes to develop potential differences between the electrodes, application of potential differences serving to introduce charges into the channels, and serving to hold and shift charges in the channels, the improvement comprising the steps of operating first drivers for all transfer electrodes on one wall surface of all lines in regular phase, operating independently of each other second drivers of transfer electrodes on the other wall surface of each line, and selectively operating third drivers for the input electrodes of all lines.

7. A method in accordance with claim 6 including one common firing means for each set of alternating transfer electrodes on said other wall, said first drivers being connected to separate common firing means for operating of the first drivers by the separate common firing means, and logic means interposed between said second drivers and the other common firing means, said logic means including line select means for controlling firing of transfer electrodes on said other wall surface by said common firing means.

8. A method in accordance with claim 7 including the steps of operating one of said second drivers to fire a transfer electrode on said other wall in conjunction with the firing of said input electrode to load a charge on a line, the regular firing by said first drivers of a transfer electrode on said one wall shifting said charge, and operating the other of said second drivers to further shift said charge, the regular firing by said first drivers of the next transfer electrode on said one wall further shifting said charge.

9. A method in accordance with claim 7 including the steps of firing one second driver in phase between the regular firing by said first drivers whereby a charge on a line is adapted to circulate between a transfer electrode on said other wall and two transfer electrodes on said one wall.

10. A method in accordance with claim 8 including the step of firing said input electrode to a first potential difference relative to said transfer electrode on said other wall for loading a charge, reducing the potential of said input electrode to an intermediate potential, and thereafter further reducing the potential of said input electrode.

11. A method in accordance with claim 10 wherein said first potential is maintained for a period less than the duration of firing of the transfer electrode by said one second driver, and wherein said intermediate potential is maintained for a period greater than the duration of firing of said transfer electrode by said one second driver and less than the combined duration of firing of said transfer electrode by said one second driver and the regular firing of a transfer electrode by said first drivers.

* * * * *